US009770899B2

(12) United States Patent
Franzoso et al.

(10) Patent No.: US 9,770,899 B2
(45) Date of Patent: Sep. 26, 2017

(54) CONTROLLING THE AMOUNT OF PRINTING FLUID

(71) Applicant: Hewlett-Packard Development Company, L.P., Houston, TX (US)

(72) Inventors: Mauricio Seras Franzoso, Sant Cugat del Valles (ES); Marina Cantero Lazaro, Barcelona (ES); Antonio Gracia Verdugo, Barcelona (ES)

(73) Assignee: HEWLETT-PACKARD DEVELOPMENT COMPANY, L.P., Houston, TX (US)

( * ) Notice: Subject to any disclaimer, the term of this patent is extended or adjusted under 35 U.S.C. 154(b) by 0 days.

(21) Appl. No.: 15/025,630

(22) PCT Filed: Oct. 14, 2013

(86) PCT No.: PCT/EP2013/071439

§ 371 (c)(1),
(2) Date: Mar. 29, 2016

(87) PCT Pub. No.: WO2015/055226

PCT Pub. Date: Apr. 23, 2015

(65) Prior Publication Data

US 2016/0221330 A1 Aug. 4, 2016

(51) Int. Cl.

| | |
|---|---|
| ***B41J 2/045*** | (2006.01) |
| ***B41J 2/165*** | (2006.01) |
| ***B41J 29/02*** | (2006.01) |
| ***B41J 11/00*** | (2006.01) |

(52) U.S. Cl.
CPC ..... *B41J 2/04535* (2013.01); *B41J 2/04586* (2013.01); *B41J 2/165* (2013.01); *B41J 2/16535* (2013.01); *B41J 11/005* (2013.01); *B41J 29/023* (2013.01); *B41J 2002/16573* (2013.01)

(58) Field of Classification Search
CPC ..... B41J 29/023; B41J 11/005
See application file for complete search history.

(56) References Cited

U.S. PATENT DOCUMENTS

| | | | | |
|---|---|---|---|---|
| 6,764,159 | B2 * | 7/2004 | Endo | B41J 2/16579 347/19 |
| 8,231,198 | B1 | 7/2012 | Askeland et al. | |
| 2003/0038856 | A1 | 2/2003 | Vega et al. | |
| 2006/0146084 | A1 * | 7/2006 | Reinten | B41J 2/165 347/15 |
| 2008/0266343 | A1 | 10/2008 | Borrell et al. | |
| 2012/0056935 | A1 | 3/2012 | Nitta | |
| 2013/0050337 | A1 | 2/2013 | Jogo et al. | |

OTHER PUBLICATIONS

PCT International Search Report, Oct. 6, 2014, PCT Patent Application No. PCT/EP2013/071439, Hewlett-Packard Development Company, L.P., European Patent Office, 3 pages.

* cited by examiner

*Primary Examiner* — Bradley Thies
(74) *Attorney, Agent, or Firm* — HP Inc.—Patent Department

(57) ABSTRACT

A method for controlling the amount of printing fluid deposited by a printhead for a plurality of passes of a swath width of a printing process is described. The printing process may include periodic servicing of the printhead. The method may include determining an amount of printing fluid to be deposited for each pass of the swath width; identifying which pass of the swath width servicing is to occur; and reducing the determined amount of printing fluid deposited during a first pass immediately following servicing of the printhead.

15 Claims, 4 Drawing Sheets

CONTROLLING THE AMOUNT OF PRINTING FLUID

CROSS-REFERENCE TO RELATED APPLICATION

This application is a U.S. National Stage Application of and claims priority to International Patent Application No. PCT/EP2013/071439, filed on Oct. 14, 2013, and entitled "CONTROLLING THE AMOUNT OF PRINTING FLUID," which is hereby incorporated by reference in its entirety.

BACKGROUND TO THE INVENTION

Printing mechanisms used in a variety of different products, such as plotters, facsimile machines and inkjet printers, for example, include mechanisms for controlling the amount of printing fluid that is deposited on media in order to print images. Some printing mechanisms use a printhead by which drops of printing fluid (for example ink, or fluids for transparent pre or post treatment, such as primers or varnishes) are deposited onto a page or sheet of print media. The performance of these printheads may become degraded by the build up residual ink. To clean and protect the printhead, typically a service station mechanism is mounted within the printer so the printhead can be serviced, for example cleaned.

BRIEF DESCRIPTION OF DRAWINGS

For a more complete understanding, reference is now made to the following description taken in conjunction with the accompanying drawings in which.

DETAILED DESCRIPTION

The following describes methods and apparatus for a controlling the amount of printing fluid deposited by a printing mechanism. The printhead deposits printing fluid (e.g. ink) onto a print media, such as paper. A printhead may have an orifice plate that is formed with nozzles through which ink drops are "fired", or otherwise ejected, onto the print media to form an image, such as text or a picture. During printing, ink tends to build up at the nozzle orifices of a printhead. This build-up of residual ink can be caused by ink droplets that are not completely ejected from a nozzle, excess ink at the orifice that is not fully vaporized, or ink spatterings from the print media when the ink is ejected. The small nozzle orifices of a printhead are also susceptible to clogging by quick drying ink, dust particles and paper fibers, and from solids within the ink. Partially or completely blocked nozzles can result in either missing or misdirected ink drops being deposited onto the print media, either of which impairs printing and degrades the print quality.

The printing assembly typically includes a service station having wipers to clean and preserve the functionality of the printheads. The service station includes a wiper, or wipers, for wiping a printhead to remove ink residue and other contaminants that have been deposited or collected on the printhead surface and over the nozzle openings in the printhead surface. A service station can also include a cap, or capping mechanism, which covers a printhead when the printer is not printing to prevent the ink in the nozzles from drying, and to prevent contaminants from collecting in and over the nozzles.

Ink has become more difficult to work with since the properties that makes it last longer for media that is exposed outdoor, for example banners for publicity campaigns, signs, advertising etc, and ink that are more resistant to scratches also add problems to printheads serviceability. Some inks are now stickier, and when the printheads are serviced (for example cleaned by wiping the nozzles) in order to prevent degradation of the nozzles it is very likely that an image quality defect would appear. This is because some of this viscous ink (after being fired with a low percentage of water) is pushed or pulled into the nozzles preventing them from firing and this residual ink may take some time to be re-dissolved. Commonly, defects occur in a zone where printheads are not firing. This occurs at the edge of the media directly after they have been wiped during servicing.

Figure 1:
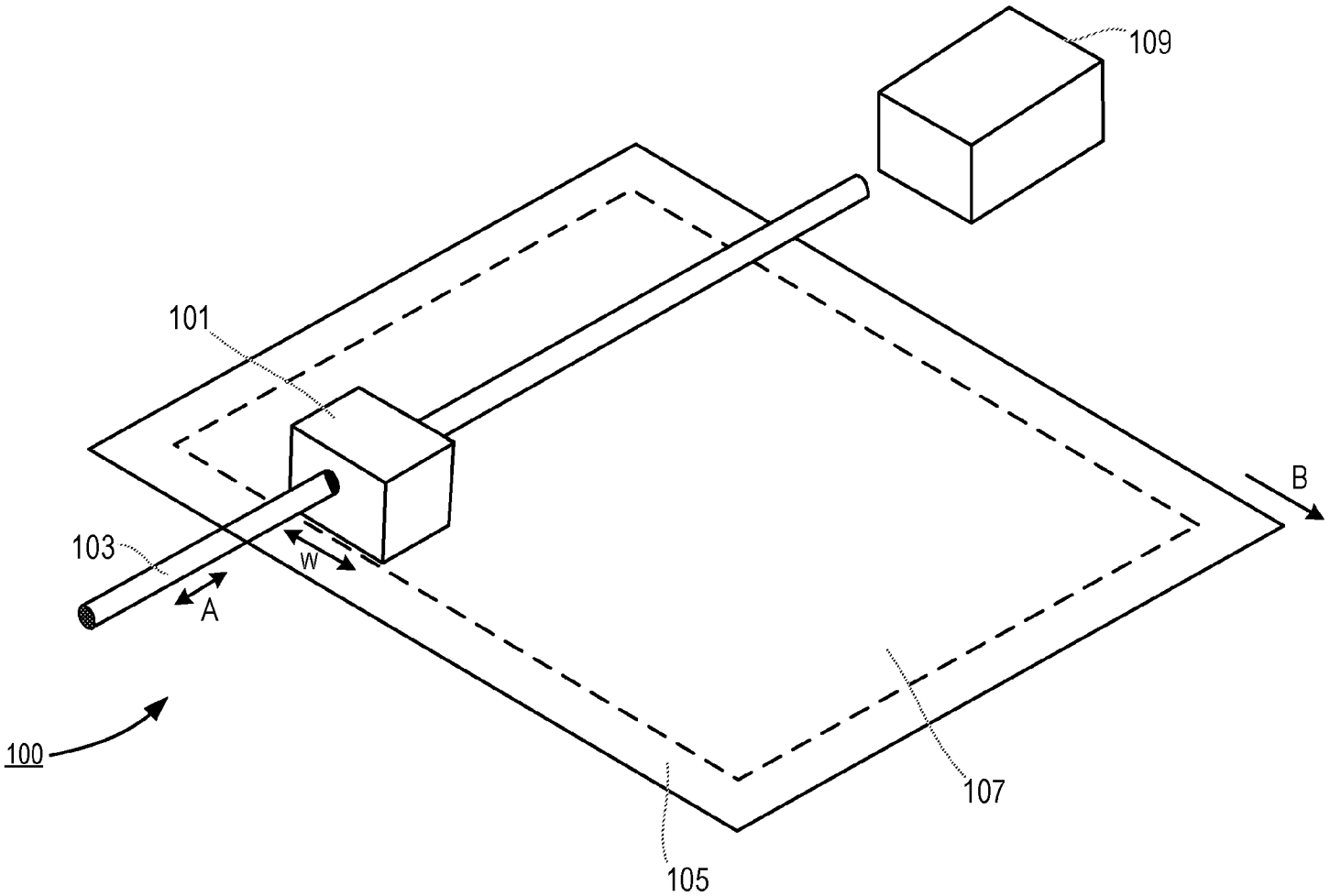
FIG. 1 is a simplified schematic of an exemplary printing mechanism.

An exemplary printing mechanism is shown in FIG. 1. The printing mechanism 100 comprises a printhead 101 for reciprocal movement along a scanning axis (direction arrow A) across a printzone 107 of a print media 105. The printhead 101 is configured to deposit ink across a swath width W (perpendicular to the scanning axis A) along the scanning axis A across the printzone 107. The printing mechanism 100 further comprises a drive mechanism (not shown in FIG. 1) configured to reciprocally drive the printhead 101 along the scanning axis A in a plurality of passes. The printing mechanism further comprises a service station 109 configured to periodically service the printhead. The printing mechanism 100 further comprises a controller (not shown in FIG. 1) configured to divide the total amount of printing fluid to be deposited for a given swath by the number of passes in which the printhead is to deposit the printing fluid. This determines the amount of ink to be deposited for each pass for each swath width. The controller is further configured to identify the occurrence of servicing and reduce the amount of ink deposited during a first pass immediately following servicing of the printhead. The amount of ink deposited in the pass immediately following servicing may be anything up to 100% less than the amount of ink originally determined to be deposited for that pass. The amount of the reduction depends on current needs of the printing process, for example, it may depend on how much puddling there is on the nozzle plate, this puddling is directly related to the firing frequency and therefore it is dependent on the plot saturation and ink levels used.

The printhead 101 is mounted onto a chassis 103. The service station 109 is located at one end of the scanning axis A just outside the printzone 107.

In one example, the service station may be moveable in the direction of the arrow B to a service station position at the edge of the printzone to contact the printhead and service the printhead. Alternatively the service station may be fixed and the printhead passes along the axis A and away from the print zone 107 to the service station for servicing.

The service station 109 may comprise an elastomeric wiper that wipes the printhead surface to remove ink residue, as well as any paper dust or other debris that has collected on the face of the printhead. The service station 109 comprises a mechanism to move the wiper to a wiper service position to service the printhead 101. This may occur in response to certain events in the printing process, for example, after spitting or uncapping of the printhead or occasionally during printing, after a certain number of passes, or at predetermined time intervals.

The printhead 101 may comprise a nozzle array arranged in one or multiple linear arrays. If more than one, the two linear arrays are located side-by-side on the printhead, parallel to one another, and perpendicular to the scanning direction A. Thus, the length of the nozzle arrays define the swath width W. That is, if all the nozzles of one array were continually fired as the printhead made one complete traverse through the printzone, a band or swath of ink would appear on the sheet, that is, the maximum pattern of ink which can be laid down in a single pass.

The printing mechanism described herein can be implemented in many different printing devices, to include inkjet printing devices.

Figure 2:
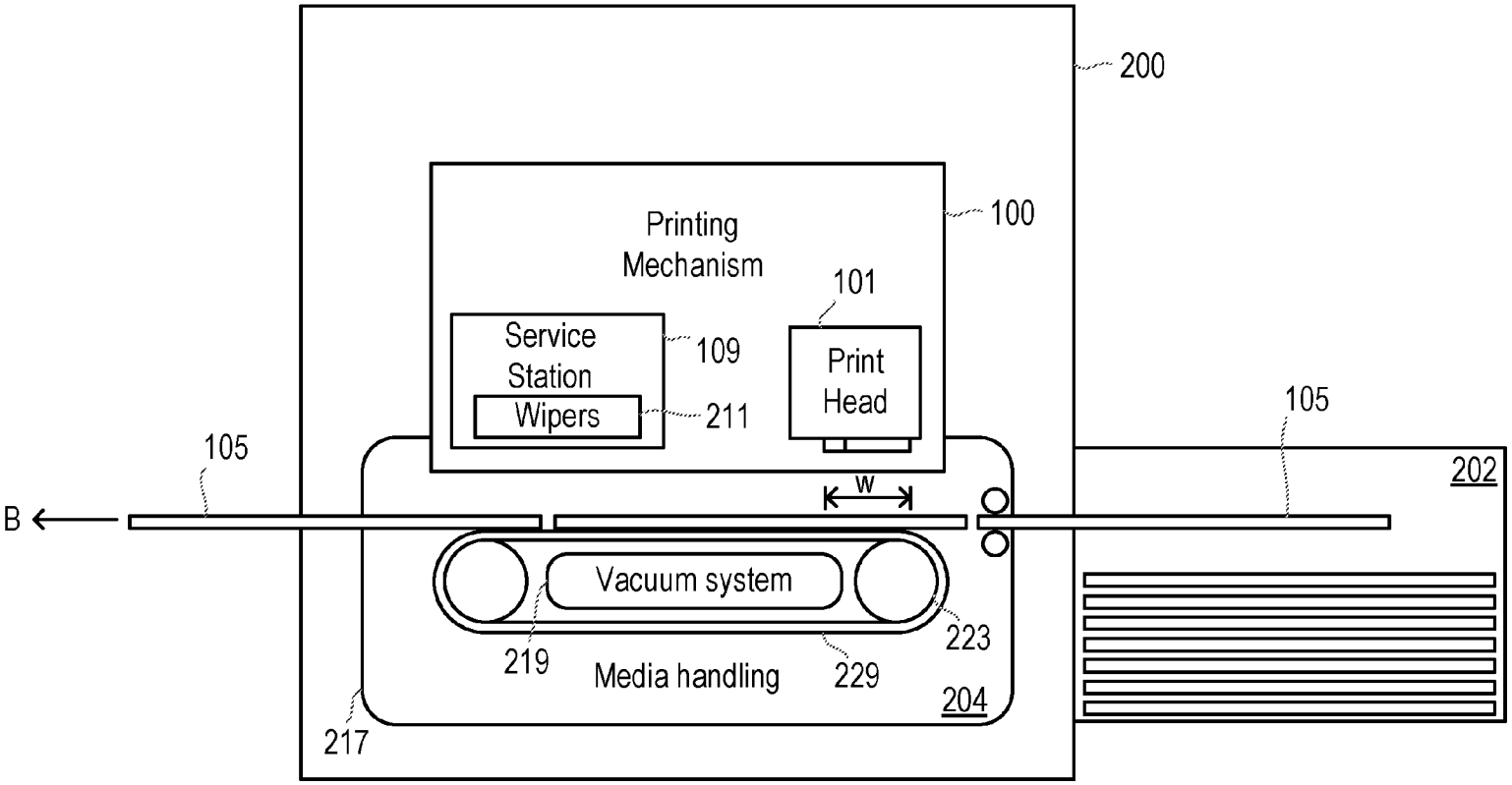
FIG. 2 is a simplified schematic of an exemplary printing device.

FIG. 2 illustrates an exemplary printing device 200 that can include one or multiple components of the exemplary printing mechanism 100 (FIG. 1). The various exemplary printing device configurations are described in the environment and context of an inkjet printing device. While it is apparent that printing device components vary from one device to the next, those skilled in the art will recognize the applicability of the exemplary printing mechanism to printing devices in general.

Printing device 200 includes a print media container 202, a media handling assembly 204, and a printing mechanism 100. The print media container 202 holds print media 105 until the media handling assembly 204 takes up a print media 105 and routes it through the printing device 200 for printing. When the print media 105 is routed within printing device 200 by the media handling assembly 204, the print media passes through a print zone in the printing device 200. Within the print zone, an imaging medium, such as ink, is transferred from the printhead 101 of the printing mechanism 100 to print media 105 in response to the printing device 200 receiving print data corresponding to a print job.

The media handling assembly 204 includes components to route print media 105 through the printing device 200. The media handling assembly components include a media routing belt 229 that is positioned to route the print media 105 through the print zone. The media routing belt 229 can be formed of a metal material, or other material that withstands the structural demands imposed by the printing process, to include localized heat that is generated to permanently fix an imaging medium, such as ink, to a print media.

The media routing belt 229 is driven by a belt drive and/or pulley and roller system 223 which is coupled to a motor drive unit (not shown). Those skilled in the art will recognize that there are any number of media handling assembly configurations that can be implemented in any number of printing devices to route print media through a printing device.

The media handling assembly also includes a vacuum system 219 to hold a print media 208 on the media routing belt 229 while the print media 105 is routed through the printing device 200. The media routing belt 229 can be perforated, or otherwise facilitate air flow through it, such that the vacuum system 219 located underneath the belt can hold the print media 105 on top of the belt while the print media is routed through the print zone.

The printing mechanism 100 includes a service station 109. The service station 109 includes a wiper assembly 211 that is mounted on, coupled to, and/or integrated with service station 109 to clean nozzle sections of the printhead 101. A wiper assembly 211 has wipers to clean the printhead 101 and remove ink residue and contaminants to maintain a desired printing quality. In FIG. 1, the printing mechanism 100 illustrates the components schematically and their relative placements as shown are not an indication of how they would be arranged in the printing device.

The nozzles of the printhead 101 are cleaned periodically during operation of printing device 200. A processor, or processors, in the printing device 200 schedules routine servicing of the printhead 101 based upon the printing time, the number of ink drops being ejected, and/or other printing related factors. For example, the printheads can be cleaned after an approximate time duration, such as after every ten minutes of printing time, or the printheads can be cleaned after a number of passes or a number of print media pages printed, such as after every one-hundred pages. The service station 218 can have multiple wiper assemblies corresponding to multiple printbar assemblies in print unit 206.

Figure 3:
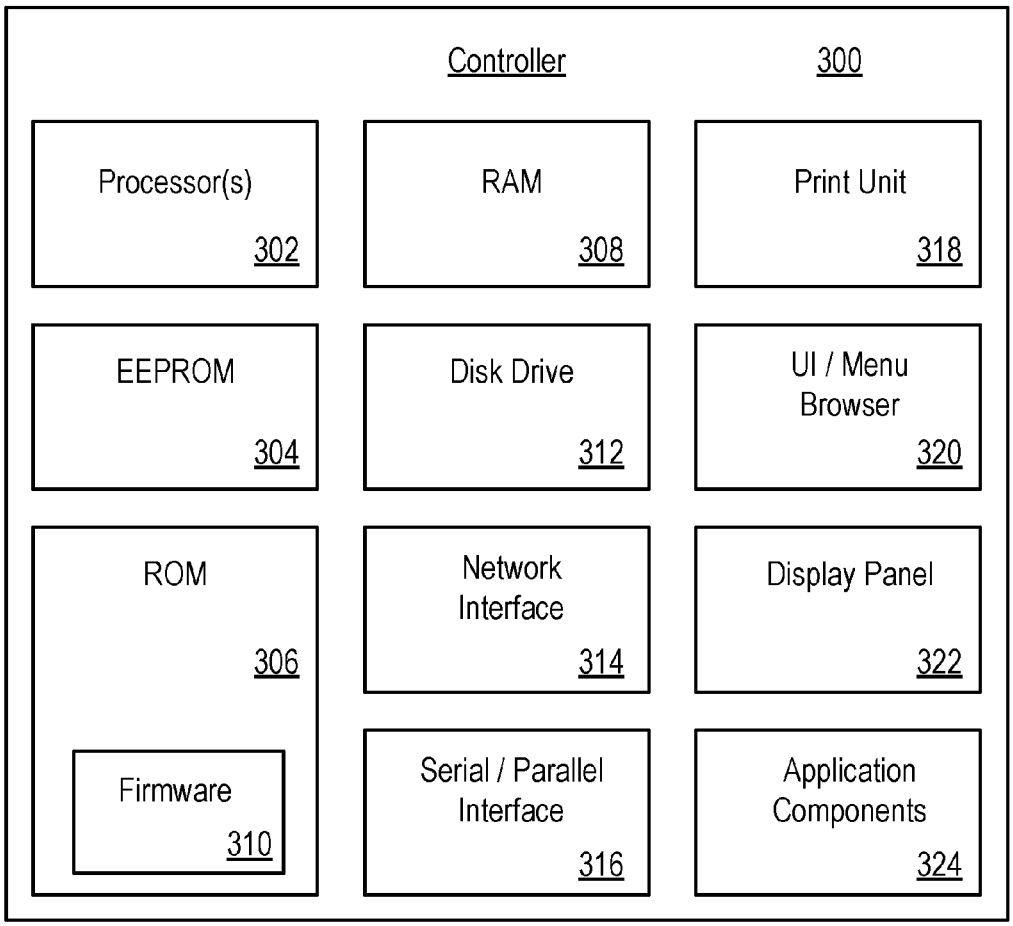
FIG. 3 is a block diagram of components of an exemplary printing device.

FIG. 3 illustrates various components of a controller 300 of the exemplary printing device 200 of FIG. 2. The controller 300 includes one or multiple processors 302, an electrically erasable programmable read-only memory (EEPROM) 304, ROM 306 (non-erasable), and a random access memory (RAM) 308. Although the controller 300 is illustrated having an EEPROM 304 and ROM 306, a particular printing device may only include one of the memory components. Additionally, although not shown, a system bus typically connects the various components within the controller 300.

The controller 300 also has a firmware component 310 that is implemented as a permanent memory module stored on ROM 306. The firmware 310 is programmed and tested like software, and is distributed with the printing device 200. The firmware 310 can be implemented to coordinate operations of the hardware within printing device 200 and contains programming constructs used to perform such operations including the exemplary method shown in FIG. 4.

Processor(s) 302 process various instructions to control the operation of the printing device 200 and to communicate with other electronic and computing devices. The memory components, EEPROM 304, ROM 306, and RAM 308, store various information and/or data such as configuration information, fonts, templates, data being printed, and menu structure information. Although not shown, a particular printing device can also include a flash memory device in place of or in addition to EEPROM 304 and ROM 306.

The controller 300 also includes a disk drive 312, a network interface 314, and a serial/parallel interface 316. Disk drive 312 provides additional storage for data being printed or other information maintained by the printing device 200. Although printing device 200 is illustrated having both RAM 308 and a disk drive 312, a particular printing device may include either RAM 308 or disk drive 312, depending on the storage needs of the printing device. For example, an inexpensive printing device may include a small amount of RAM 308 and no disk drive 312, thereby reducing the manufacturing cost of the printing device.

Network interface 314 provides a connection between controller 300 and a data communication network. The network interface 314 allows devices coupled to a common data communication network to send print jobs, menu data, and other information to controller 300 via the network. Similarly, serial/parallel interface 316 provides a data communication path directly between controller 300 and another electronic or computing device. Although the controller 300 is illustrated having a network interface 314 and serial/parallel interface 316, a particular printer may only include one interface component.

The controller 300 also includes a print unit 318 that includes mechanisms arranged to selectively control the printhead 101 to apply an imaging medium such as liquid ink, toner, and the like to a print media in accordance with print data corresponding to a print job. Print media can include any form of media used for printing such as paper, plastic, fabric, Mylar, transparencies, and the like, and different sizes and types such as 8½×11, A4, roll feed media, etc. For example, the print unit 318 may control a printing mechanism (such as, for example, an inkjet printing mechanism) that selectively causes ink to be applied to a print media in a controlled fashion. The ink on the print media can then be more permanently fixed to the print media, for example, by selectively applying conductive or radiant thermal energy to the ink. Those skilled in the art will recognize that there are many different types of printing mechanisms available, and that for the purposes of the disclosure below, print unit 318 can include any of these different types.

The controller 300 also includes a user interface and menu browser 320, and a display panel 322. The user interface and menu browser 320 allows a user of the printing device 200 to navigate the printer's menu structure. User interface 320 can be indicators or a series of buttons, switches, or other selectable controls that are manipulated by a user of the printing device. Display panel 322 is a graphical display that provides information regarding the status of the printing device 200 and the current options available to a user through the menu structure.

The controller 300 can, and typically includes application components 324 that provide a runtime environment in which software applications or applets can run or execute. Those skilled in the art will recognize that there are many different types of runtime environments available. A runtime environment facilitates the extensibility of printing device 200 by allowing various interfaces to be defined that, in turn, allow the application components 324 to interact with the printing device.

Figure 4:
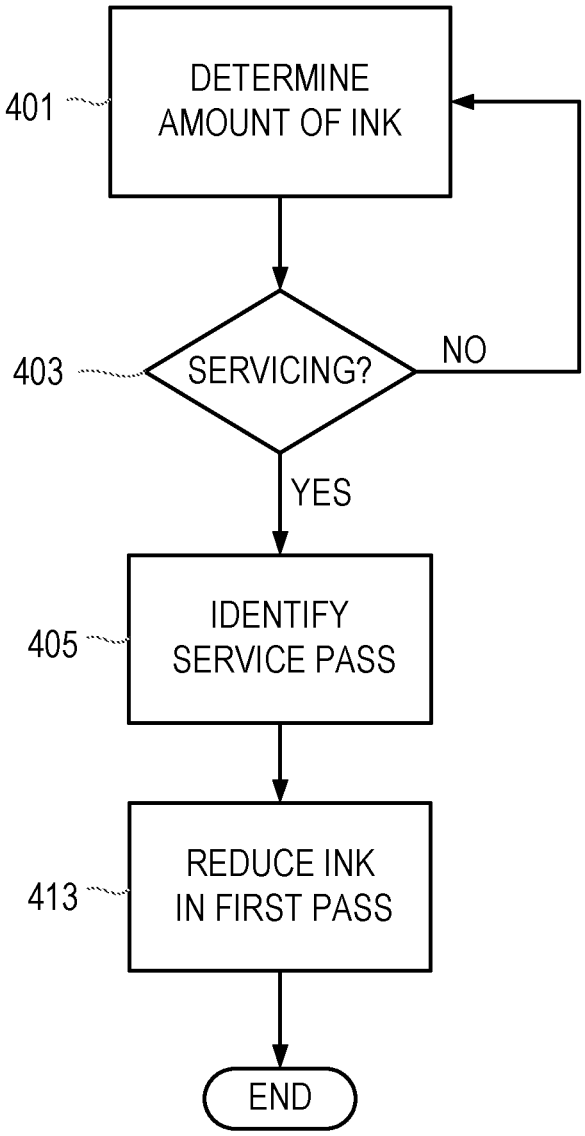
FIG. 4 is a flowchart of an example of a method of controlling the amount of ink for a printing process.

The print unit 318 is controlled by the processors 302 which execute a series of instructions to perform the printing process. Before an image can be printed it has to be treated and transformed to something that the printer can manage. At the end are needed the number and position of drops that have to be fired in each scan and this is done through mask files. An example of this process is shown in FIG. 4. An amount of ink for each of a plurality of passes of each swath width is determined, 401, such that the location and the number of drops of ink to be deposited at each location is determined for each pass of each swath width. If servicing is scheduled to be performed for that swath width, 403, the pass in which servicing is to be preformed is identified, 405, and the determined amount of ink for the swath width is redetermined, 413, between the passes such that the amount of ink deposited during the first pass immediately following servicing of the printhead is less than the ink determined to be deposited for that pass. The remaining ink required for that swath width is than divided by the number of passes before servicing and the remaining passes after the first pass such that the total amount of ink for that swath width is still deposited. As a result, the amount of ink deposited in the first pass may be significantly less than the ink deposited in the other passes of the swath width. The process then ends. If it is determined that no servicing is required, 403, the determined ink amounts for each pass remain unchanged and the process ends. This is then repeated for each swath width of the complete print process.

As a result, much less ink is deposited in the pass that has a higher likelihood to generate image quality defects (this is the pass immediately following servicing, e.g. following wiping). The remaining passes are then used to deposit the correct amount of ink that the scan width gaining much more margin to hide possible defects. Firing less drops in the pass immediately after servicing allows enough time for any non-firing nozzles which have become temporarily blocked by servicing (e.g. caused by the wiping process) to recover. The amount of ink deposited during the previous and following passes is adjusted so that the total amount of ink is deposited to complete the printing of the image without such image quality defects. This may be implemented by simply adding a first mask to be used for the passes previous to servicing, a second mask for the pass immediately following servicing and a third mask to be used for the passes thereafter. The second mask is such that significantly less ink is deposited.

These masks allow the ink that is not fired due to temporary blockage caused by servicing of the nozzles to be compensated for. These masks prevent image quality defects that otherwise would appear due to the ink not firing from the nozzles temporarily blocked due to servicing (e.g. the wiping process). As a result it provides increased robustness to the whole printing system in terms of image quality.

Although various examples have been illustrated in the accompanying drawings and described in the foregoing detailed description, it will be understood that the invention is not limited to the examples disclosed, but is capable of numerous modifications.

The invention claimed is:

1. A method for controlling the amount of printing fluid deposited by a printhead for a plurality of passes of a swath width of a printing process, the printing process including periodic servicing of the printhead, the method comprising:

determining an amount of printing fluid to be deposited for each of the plurality of passes of the swath width;

identifying in which pass of the swath width servicing is to occur;

determining plot saturation and printing fluid levels used during the plurality of passes prior to the servicing;

determining an amount of reduction in the determined amount of printing fluid to be deposited during a first pass immediately following the occurrence of the servicing of the printhead based upon the determined plot saturation and printing fluid levels; and reducing the determined amount of printing fluid deposited during the first pass by the determined amount of reduction.

2. The method as recited in claim 1, wherein the method further comprises redetermining the amount of printing fluid to be deposited for the plurality of passes other than the first pass of the swath width to compensate for the reduction in the determined amount of printing fluid deposited during the first pass.

3. A method as recited in claim 2, wherein redetermining the amount of printing fluid comprises:

determining a first mask for the passes before the occurrence of the servicing, a second mask for the first pass immediately following the occurrence of the servicing and a third mask for the plurality of passes other than the first pass.

4. The method as recited in claim 2, wherein redetermining the amount of printing fluid further comprises redetermining the amount of printing fluid to have a total amount that is equivalent to the determined amount of printing fluid and the reduced determined amount of printing fluid to be deposited prior to the occurrence of the periodic servicing and the first pass immediately following the occurrence of the periodic servicing.

5. The method as recited in claim 1, wherein the printhead comprises a nozzle array, the nozzle array for depositing printing fluid droplets and wherein the step of determining an amount of printing fluid to be deposited for each of the plurality of passes of the swath width comprises determining a mask for masking the nozzle array to control the amount of printing fluid deposited.

6. An apparatus for controlling the amount of printing fluid deposited by a printhead for a plurality of passes of a swath width of a printing process, the printing process including periodic servicing of the printhead, the apparatus comprising:

a processor to determine an amount of printing fluid to be deposited for each of the plurality of passes for the swath width, to identify which pass of the swath width servicing is to occur, to calculate an amount of puddling on a nozzle plate, determine an amount of reduction in the determined amount of printing fluid to be deposited during a first pass immediately following the occurrence of the servicing of the printhead based upon the calculated amount of puddling, and to deposit printing fluid during the first pass, wherein the printing fluid amount is reduced by the determined amount of reduction.

7. The apparatus as recited in claim 6, wherein the processor is further to redetermine the amount of printing fluid to be deposited for the plurality of passes other than the first pass of the swath width to compensate for the reduction in the determined amount of printing fluid deposited during the first pass, wherein the redetermined amount of printing fluid has a total amount that is equivalent to the determined amount of printing fluid and the reduced determined amount of printing fluid to be deposited prior to the occurrence of the periodic servicing and the first pass immediately following the occurrence of the periodic servicing.

8. A printing device for printing an image, the printing device comprising:

a printing mechanism, the printing mechanism comprising:

a chassis for mounting a printhead thereon for reciprocal movement along a scanning axis across a printzone, the printhead controllable to deposit a predetermined amount of printing fluid onto media across a swath width along the scanning axis across the printzone of the media;

a drive mechanism to reciprocally drive a mounted printhead along the scanning axis in a plurality of passes for the swath width;

a service station to periodically service a mounted printhead by cleaning a surface of the printhead; and a controller to determine an amount of printing fluid to be deposited for each of a plurality of passes for the swath width, to identify which pass of the swath width servicing is to occur, to determine a plot saturation and printing fluid levels used during the plurality of passes prior to the servicing, to determine an amount of reduction in the determined amount of printing fluid to be deposited during a first pass immediately following the occurrence of the servicing of the printhead based upon the determined plot saturation and printing fluid levels, and to deposit printing fluid during the first pass, wherein the printing fluid amount is reduced by the determined amount of reduction.

9. The printing device as recited in claim 8, wherein the controller is further to redetermine the amount of printing fluid to be deposited for the number of passes other than the first pass immediately following servicing of the mounted printhead of the swath width to compensate for the reduction in the determined amount of printing fluid deposited during the first pass.

10. The printing device as recited in claim 8, wherein the service station comprises a wiper assembly to be periodically moved to a wiper service position to service a mounted printhead.

11. The printing device as recited in claim 10, wherein the wiper assembly is further to be moved after a predetermined number of passes have occurred.

12. The printing device as recited in claim 10, wherein the wiper assembly is further to be moved at predetermined time intervals.

13. The printing device as recited in claim 8, wherein the service station is located at one end of the chassis.

14. The printing device as recited in claim 8, wherein the controller is further to determine a mask for masking a nozzle array of a mounted printhead to control the amount of printing fluid deposited.

15. The printing device as recited in claim 8, wherein the controller is further to determine a first mask for the passes before the occurrence of the servicing, a second mask for the first pass immediately following the occurrence of the servicing and a third mask for the passes other than the first pass.

* * * * *